US007297026B2

(12) United States Patent
Toda et al.

(10) Patent No.: US 7,297,026 B2
(45) Date of Patent: Nov. 20, 2007

(54) CONNECTOR WITH A SHELL HAVING A FUNCTION OF GUIDING INSERTION AND REMOVAL OF A MATING CONNECTOR

(75) Inventors: Kentaro Toda, Tokyo (JP); Yukitaka Tanaka, Tokyo (JP); Daisuke Machihara, Tokyo (JP); Hiroaki Kinoshita, Tokyo (JP); Kazuomi Sato, Tokyo (JP); Keiichiro Suzuki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/524,645

(22) Filed: Sep. 21, 2006

(65) Prior Publication Data

US 2007/0066120 A1 Mar. 22, 2007

(30) Foreign Application Priority Data

Sep. 21, 2005 (JP) ..... 2005-273502

(51) Int. Cl.
*H01R 13/648* (2006.01)

(52) U.S. Cl. ..... 439/607; 439/680

(58) Field of Classification Search ..... 439/607, 439/608, 609, 610, 378, 680
See application file for complete search history.

(56) References Cited

U.S. PATENT DOCUMENTS

| | | | | |
|---|---|---|---|---|
| 5,865,646 | A * | 2/1999 | Ortega et al. | 439/607 |
| 6,095,862 | A * | 8/2000 | Doye et al. | 439/607 |
| 6,364,707 | B1 * | 4/2002 | Wang | 439/607 |
| 6,561,849 | B2 * | 5/2003 | Naito et al. | 439/607 |
| 7,044,782 | B2 * | 5/2006 | Enami et al. | 439/564 |
| 7,150,653 | B1 * | 12/2006 | Mason | 439/609 |
| 2001/0049209 | A1 * | 12/2001 | Casey et al. | 439/76.1 |
| 2005/0048840 | A1 * | 3/2005 | Zhang | 439/607 |
| 2006/0040555 | A1 * | 2/2006 | Chen et al. | 439/607 |

FOREIGN PATENT DOCUMENTS

| | | |
|---|---|---|
| JP | 2001-93626 | 4/2001 |
| JP | 2004-319522 | 11/2004 |

* cited by examiner

*Primary Examiner*—Hien Vu
(74) *Attorney, Agent, or Firm*—Collard & Roe, P.C.

(57) ABSTRACT

In a connector including a contact and a housing holding the contact, a shell is coupled with the housing. The housing has a coupling portion to be coupled with a mating connector in a first direction. The contact has a contacting portion disposed in the coupling portion. The shell includes an opening edge defining an opening faced to the coupling portion and a guide portion disposed in the coupling portion to guide movement of the mating connector in the first direction.

10 Claims, 4 Drawing Sheets

CONNECTOR WITH A SHELL HAVING A FUNCTION OF GUIDING INSERTION AND REMOVAL OF A MATING CONNECTOR

This application claims priority to prior Japanese patent application JP 2005-273502, the disclosure of which is incorporated herein by reference.

BACKGROUND OF THE INVENTION

This invention relates to a connector with a shell having an opening for insertion of a mating connector. The connector with the shell will be called hereunder a shell connector.

Japanese Unexamined Patent Application Publication (JP-A) No. 2001-93626 discloses a conventional shell connector. The connector comprises a housing holding a contact and a shielding metal shell overlapped on a surface of the housing by a bending process. To the metal shell, a locking member as a separate component is coupled. The locking member is adapted to be engaged with a terminal portion of a mating connector. However, the above-mentioned connector requires a large number of parts and the bending process such as staking or caulking upon assembling. Accordingly, much time and labor are required to produce the connector and a finished product is varied in quality.

Japanese Unexamined Patent Application Publication (JP-A) No. 2004-319522 discloses another conventional shell connector. The connector comprises a housing holding a contact and a shielding shell fitted over the housing. The shell has a spring contacting member to be contacted with a mating connector and a tongue member to be ground-connected to a substrate. However, since the spring contacting member is formed by a bending process such as staking or caulking, much time and labor are required to produce the connector and a finished product is varied in quality.

In either case, it is difficult to finish the connector at a low cost and with high accuracy. In addition, high-density mounting is difficult. Furthermore, although a mechanical strength of an outer surface is assured, no consideration is made about a mechanical strength of a coupling portion for insertion of the mating connector. Therefore, if the mating connector is repeatedly inserted and removed for a long period of time, the coupling portion may be worn or the spring contacting member may be subjected to buckling distortion, Sometimes, the spring contacting member is broken. As a result, it is impossible to guarantee high durability and reliability.

SUMMARY OF THE INVENTION

It is therefore an object of this invention to provide a shell connector improved in mechanical strength so that a mating connector is stably inserted and removed.

It is another object of this invention to provide a shell connector having a shell structure high in durability and reliability.

It is still another object of this invention to provide a shell connector which can easily be produced at a low cost, with high accuracy, and at high productivity.

Other objects of the present invention, there is provided a connector comprising a contact having a contacting portion, a housing holding the contact, and a shell coupled with the housing, the housing having a coupling portion to be coupled with a mating connector in a first direction, the contacting portion being disposed in the coupling portion, the shell comprising an opening edge defining an opening faced to the coupling portion and a guide portion disposed in the coupling portion to guide movement of the mating connector in the first direction.

DESCRIPTION OF THE PREFERRED EMBODIMENTS

Figure 1:
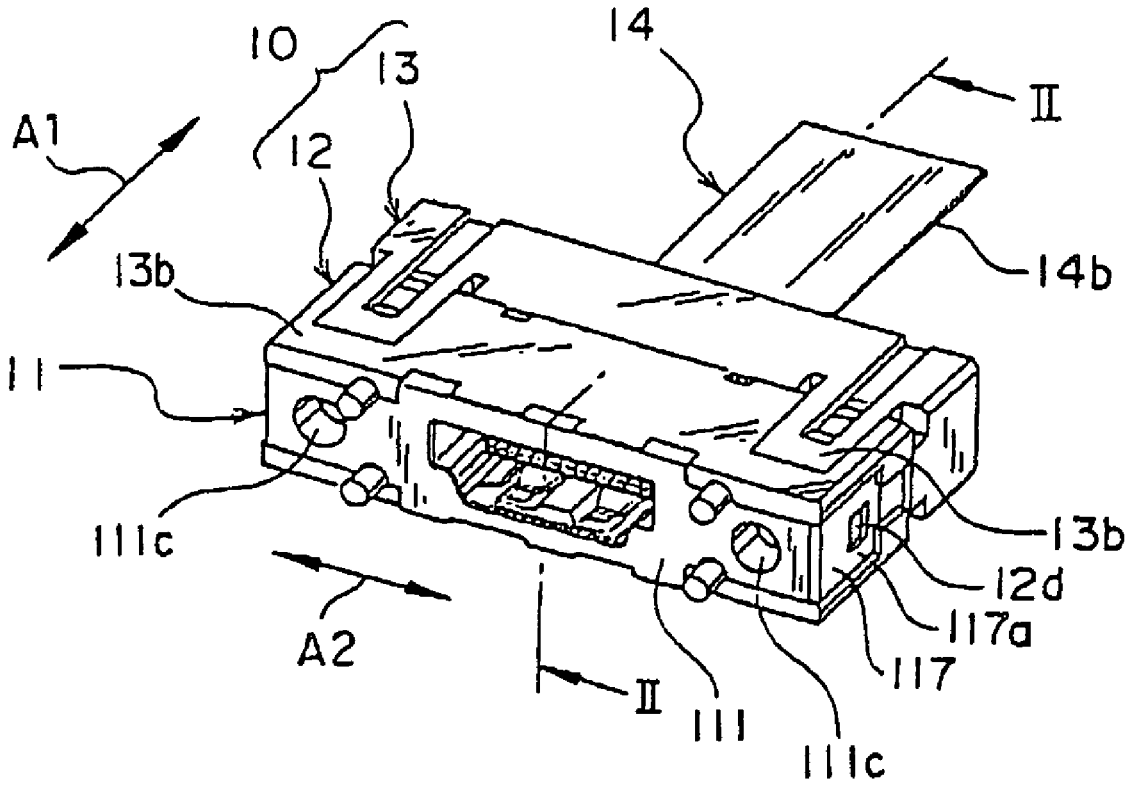
FIG. 1 is a perspective view of a shell connector according to an embodiment of this invention.
Figure 2:
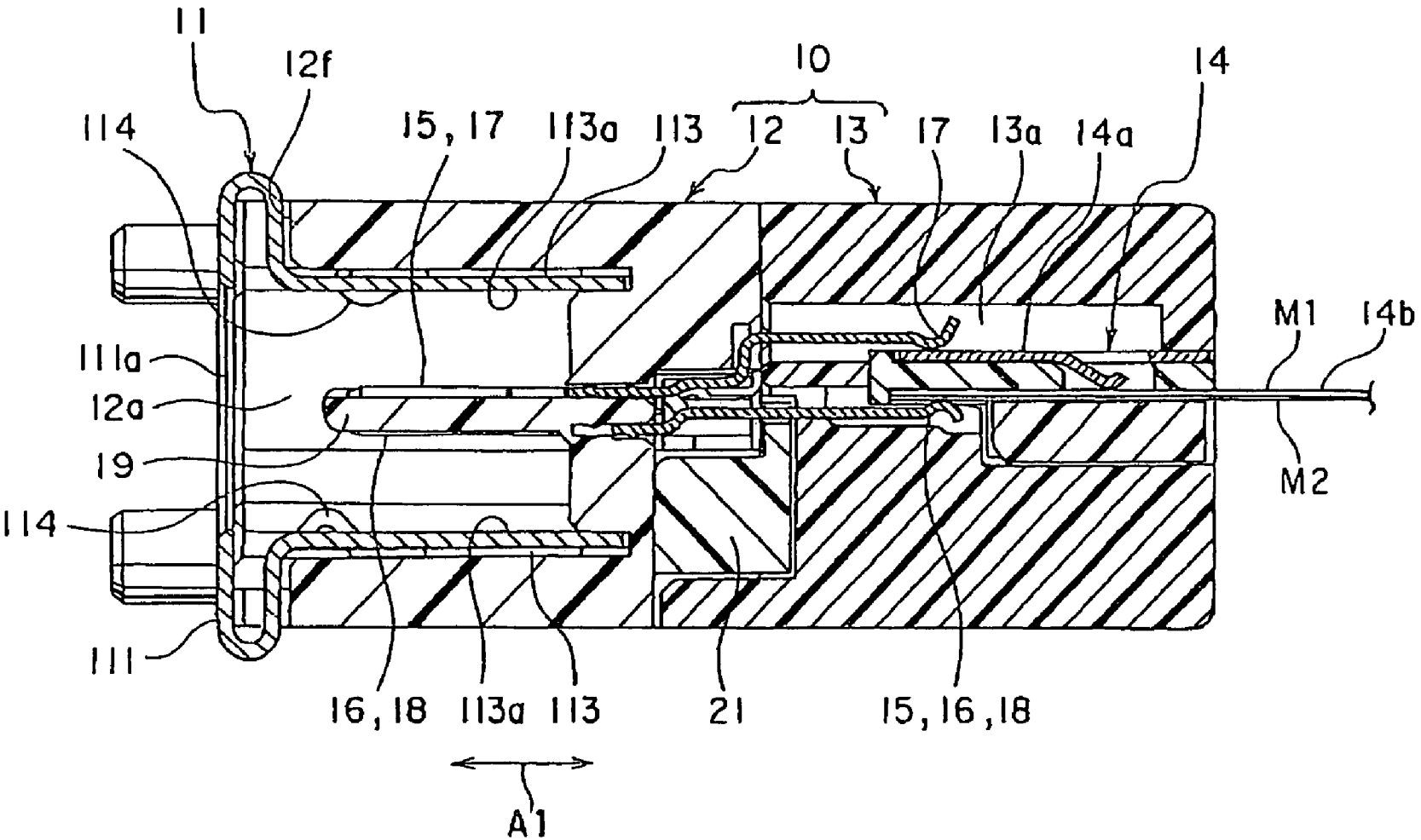
FIG. 2 is a sectional view taken along a line II-II in FIG. 1.
Figure 3:
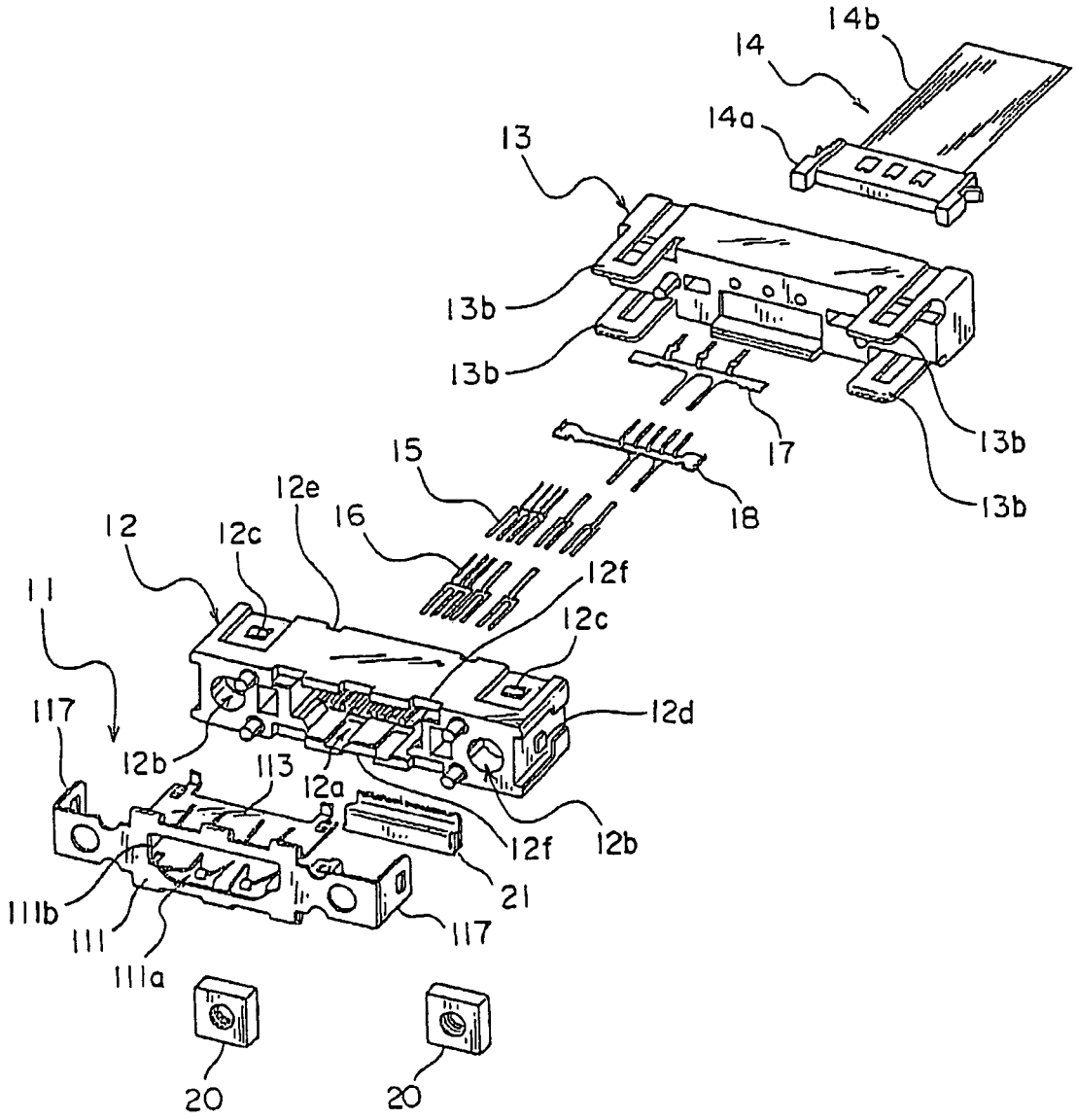
FIG. 3 is an exploded perspective view of the shell connector in FIG. 1.

Referring to FIGS. 1 to 3, description will be made of a whole of a shell connector according to an embodiment of this invention.

The shell connector illustrated in the figures is of a female type adapted to be connected to and disconnected from an I/O connector of a male type or the like as a mating connector. The connector comprises a housing 10 including an insulating front housing 12 and an insulating rear housing 13 coupled with the front housing 12. The housing 10 holds a plurality of types of conductive contacts 15, 16, 17, and 18. Herein, the contacts 15 and 16 are connected to signal lines while the contacts 17 and 18 are connected to ground lines.

The front housing 12 has a coupling portion, i.e., a coupling hole 12*a* adapted to receive the mating connector coupled thereto in a first direction (back-and-forth direction) A1. The coupling hole 12*a* is opened at a front surface of the front housing 12, i.e., a coupling surface. Each of the contacts 15, 16, 17, and 18 has a part exposed in the coupling hole 12*a* as a contacting portion. However, the contacts 15, 16, 17, and 18 are insulated from one another by an inner protrusion 19. In the coupling hole 12*a*, the contacts 15, 16, 17, and 18 are arranged in a second direction (transversal direction) A2 perpendicular to the first direction A1.

The front housing 12 is provided with a pair of screw fitting holes 12*b* formed near opposite ends in the second direction A2, respectively, locking claws 12*c* formed on its upper and lower surfaces near the opposite ends in the second direction A2, respectively, and protruding portions 12*d* formed on opposite end faces in the second direction A2, respectively. To the front housing 12, a shell 11 formed by a conductive plate-like material is coupled.

On the other hand, the rear housing 13 has a fitting hole 13*a* formed on its rear side to fit a connection object component 14. The connection object component 14 comprises a conductive component shell 14*a* connected to a FFC (Flexible Flat Cable) 14*b* comprising a collection of a predetermined number of conductive wires. When the connection object component 14 is inserted to the fitting hole 13*a*, the component shell 14*a* is electrically connected to the contact 17 and the FFC 14*b* is electrically connected to the other contacts 15, 16, and 18.

The rear housing 13 has locking members 13*b* engaged with the locking claws 12*c* of the front housing 12, respectively. The locking members 13*b* are elastically flexible in a vertical direction.

Figure 4A:
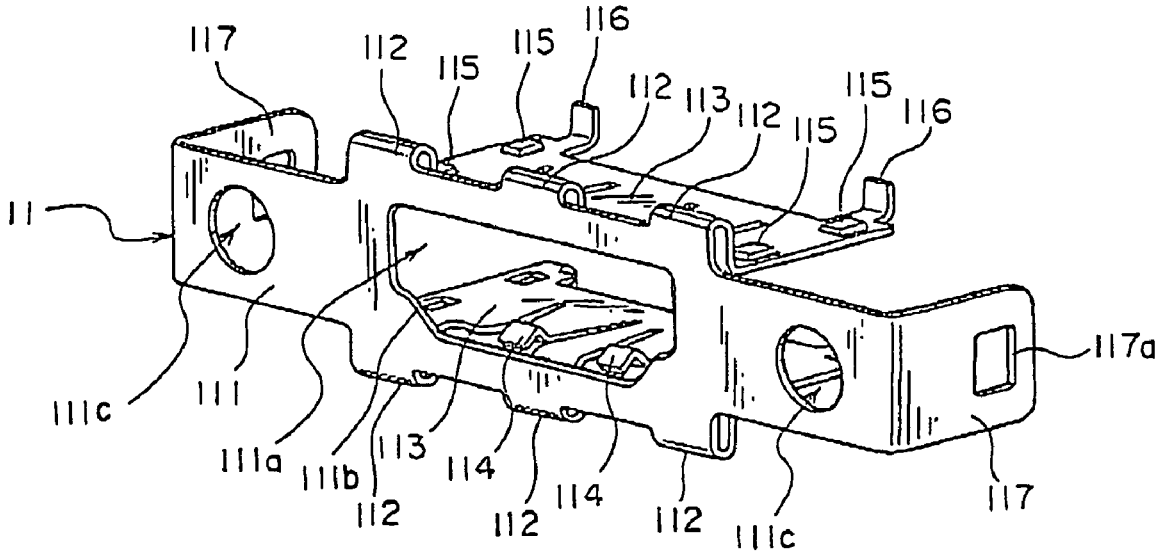
FIG. 4A is a perspective view of a shell of the shell connector in FIG. 1 as seen in one direction.
Figure 4B:
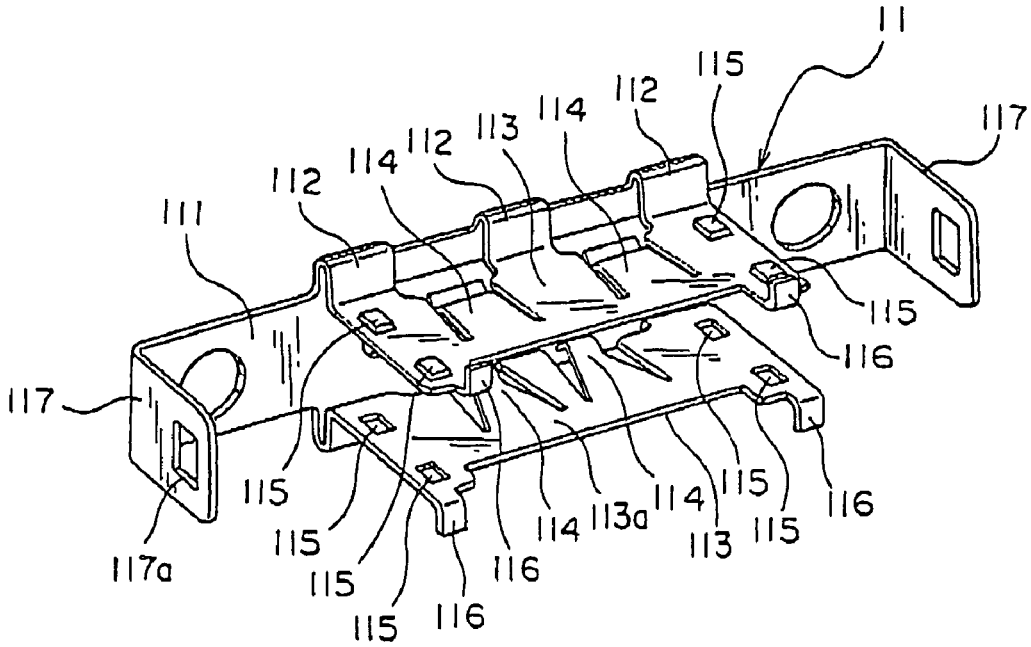
FIG. 4B is a perspective view of the shell in FIG. 4A as seen in another direction.

Referring to FIGS. 4A and 4B in addition, description will be made of the shell 11.

The shell 11 has a main body 111 covering the coupling surface of the front housing 12. The main body 111 has an opening edge 111*b* defining an insertion opening 111*a* faced to the coupling hole 12*a* of the front housing 12. The opening edge 111*b* has an asymmetrical shape with respect to a virtual plane extending along the first and the second directions A1 and A2 and including the inner protrusion 19. Specifically, the opening edge 111*b* has a linear upper side and a curved lower side.

The shell 11 further has a pair of plate-like guide portions 113 extending from upper and lower edges of the main body 111 and inserted into the coupling hole 12*a* of the front housing 12. The guide portions 113 serves to guide movement of the mating connector in the first direction A1.

Each of the guide portions 113 has a flat guide surface 113*a* positioned on a substantial extension of the opening edge 11*b* in the first direction A1. Specifically, each of a plane containing a lower surface of the upper guide portion 113 and the upper side of the opening edge 111*b* and a plane containing an upper surface of the lower guide portion 113 and a lowermost part of the lower side of the opening edge 111*b* is substantially parallel to the above-mentioned virtual plane.

Each of the guide portions 113 has a plurality of, i.e., two spring members 114 formed at an intermediate position in the second direction A2 and protruding from the guide surface 113*a*. The spring members 114 are elastically press-contacted with an outer wall surface of the mating connector inside the coupling hole 12*a* of the front housing 12 and serve as ground springs as will later be described. Each of the spring members 114 extends towards the insertion opening 111*a* and has an end portion bent outward.

Each of the guide portions 113 has a plurality of, i.e., two press-fit dowels 115 and a fixing member 116 formed at each of opposite ends in the second direction A2. The press-fit dowels 115 are press-fitted to recesses (not shown) formed on the front housing 12. The fixing member 116 is formed by bending. The fixing member 116 is fitted to a recess 12*e* formed on the front housing 12 and fixedly engaged with the front housing 12 in the first direction A1. Thus, each of the guide portions 113 is kept spaced from the contacting portions of the contacts 15, 16, 17, and 18. A combination of the press-fit dowels 115 and the fixing member 116 will herein be called a holding portion. End faces at end portions of the fixing members 116 are exposed on the upper and the lower surfaces of the front housing 12 after the shell 11 is coupled to the front housing 12.

The shell 11 has a pair of spring locking members 117 formed at opposite ends of the main body 11 in the second direction A2 and extending in the first direction A1 to face side surfaces of the front housing 12, respectively. Each of the spring locking members 117 has an engaging hole 117*a* fitted to and engaged with the protruding portion 12*d* of the front housing 12.

Upon forming the guide portions 113, projecting portions 112 are formed at six positions by bending. Between adjacent ones of the projecting portions 112, the ground springs 114 are formed via a punching process including cutting. These projecting portions 112 are fitted to a plurality of recesses 12*f* formed on upper and lower edge portions of the coupling surface of the front housing 12, respectively.

The shell 11 and the front housing 12 are fixed to a casing or the like of an electrical unit or an electronic unit by the use of screw fixing members (nuts) 20, a middle housing 21, and screws (bolts). For this purpose, the main body 111 is provided with screw openings 111*c* formed near the opposite ends in the second direction A2.

Next, description will be made of a method of using the above-mentioned shell connector.

At first, as illustrated in FIG. 2, the connection object component 14 is fitted into the fitting hole 13*a*. Consequently, the component shell 14*a* press-contacted with a single solid ground surface M1 of the FFC 14*b* is connected to the contact 17. On the other hand, conductive patterns on a patterned surface M2 of the FFC 14*b* are connected to the contacts 15, 16, and 18.

Next, the mating connector is inserted into the coupling hole 12*a* in the first direction A1. At this time, the mating connector is guided by the guide surfaces 113*a*. In particular, since the spring members 114 are elastically press-contacted with the outer wall surface of the mating connector, a guiding function is improved and insertion is stably carried out.

When the mating connector is completely fitted into the coupling hole 12*a*, the mating connector is contacted with the contacts 15, 16, 17, and 18 inside the coupling hole 12*a* and achieves desired electrical connection to the connection object component 14. Simultaneously, since the spring members 114 are elastically press-contacted with the outer wall surface of the mating connector, the shell 11 is electrically connected to at least one of the contacts 17 and 18 via the mating connector. Therefore, the shell 11 is connected to the solid ground surface M1 of the FFC 14*b*. At this time, the spring members 114 serve as the ground springs.

While the present invention has thus far been described in connection with a single embodiment thereof, it will readily be possible for those skilled in the art to put this invention into practice in various other manners. For example, although the description has been made about the case where the connector has a plurality of contacts, this invention is similarly implemented in a connector having a single contact. Although the housing comprises a combination of a plurality of components in the foregoing, the housing may be integrally formed. Although the shell has a pair of guide portions, one of the guide portions may be replaced by a wall surface of the housing.

What is claimed is:

1. A connector comprising:

a contact having a contacting portion;

an insulating housing holding the contact; and a conductive shell coupled with the housing;

the housing having an inner surface defining a coupling hole adapted to receive a mating connector in a first direction, the coupling hole opening at a front coupling surface of the housing having a recess;

the contacting portion being disposed in the coupling hole;

the conductive shell comprising:

a main body covering the front coupling surface and having an opening edge defining an insertion opening interfacing with the coupling hole;

a guide portion having fixing members at one end and extending along the inner surface of the housing to guide movement of the mating connector in the first direction; and a projecting portion connected between the main body and the guide portion to protrude though the recess and outwardly from the main body and insulating housing in a direction perpendicular to the first direction, the projecting portion being of a U-shape in section and positioning the shell relative to the housing.

2. The connector according to claim 1, wherein the guide portion has a guide surface positioned on a substantial extension of the opening edge in the first direction.

3. The connector according to claim 1, wherein the shell has an additional guide portion disposed in the coupling hole to guide movement of the mating connector in the first direction in cooperation with the guide portion.

4. The connector according to claim 1, wherein the guide portion has a spring member to be elastically press-contacted with the mating connector in the coupling hole.

5. The connector according to claim 1, wherein the guide portion has a holding portion held by the housing.

6. The connector according to claim 1, wherein the guide portion extends from the main body towards the coupling hole and is spaced from the contacting portion.

7. The connector according to claim 6, wherein the guide portion is connected to an outer peripheral portion of the main body.

8. The connector according to claim 1, wherein the shell has a pair of spring locking members formed at opposite ends of the main body in a second direction perpendicular to the first direction and extending in the first direction to be engaged with the housing.

9. The connector according to claim 8, wherein the opening edge is asymmetrical with respect to a plane extending along the first and the second directions.

10. The connector according to claim 9, wherein the guide portion has a pair of guide surfaces formed on opposite sides of the plane.

* * * * *

UNITED STATES PATENT AND TRADEMARK OFFICE

CERTIFICATE OF CORRECTION

PATENT NO. : 7,297,026 B2
APPLICATION NO. : 11/524645
DATED : November 20, 2007
INVENTOR(S) : Toda et al.

It is certified that error appears in the above-identified patent and that said Letters Patent is hereby corrected as shown below:

Column 3, line 17, please change "11b" to correctly read: --111b--.

Signed and Sealed this

Twenty Second Day of April, 2008

JON W. DUDAS
*Director of the United States Patent and Trademark Office*